US009368304B2

(12) United States Patent
Heinrich et al.

(10) Patent No.: US 9,368,304 B2
(45) Date of Patent: Jun. 14, 2016

(54) POLARIZED ELECTROMAGNETIC RELAY AND METHOD FOR PRODUCTION THEREOF

(71) Applicant: Phoenix Contact GmbH & Co. KG, Blomberg (DE)

(72) Inventors: Jens Heinrich, Falkensee (DE); Christian Mueller, Berlin (DE); Ralf Hoffmann, Berlin (DE)

(73) Assignee: Phoenix Contact GmbH & Co. KG (DE)

( * ) Notice: Subject to any disclaimer, the term of this patent is extended or adjusted under 35 U.S.C. 154(b) by 0 days.

(21) Appl. No.: 14/388,104

(22) PCT Filed: Mar. 27, 2013

(86) PCT No.: PCT/EP2013/056547
§ 371 (c)(1),
(2) Date: Sep. 25, 2014

(87) PCT Pub. No.: WO2013/144218
PCT Pub. Date: Oct. 3, 2013

(65) Prior Publication Data

US 2015/0048909 A1 Feb. 19, 2015

(30) Foreign Application Priority Data

Mar. 30, 2012 (DE) ..... 10 2012 006 436

(51) Int. Cl.
*H01H 51/22* (2006.01)
*H01H 50/04* (2006.01)
(Continued)

(52) U.S. Cl.
CPC ..... *H01H 51/2236* (2013.01); *H01H 49/00* (2013.01); *H01H 50/041* (2013.01); *H01H 51/22* (2013.01); *H01F 7/122* (2013.01); *Y10T 29/49073* (2015.01)

(58) Field of Classification Search
CPC . H01H 50/041; H01H 49/00; H01H 51/2236; H01H 51/22; H01H 45/00; H01H 45/02; H01H 45/04; H01H 45/06; H01H 45/08; H01H 51/01; H01H 50/541; H01H 50/02; H01H 50/14; H01H 50/18; H01H 50/54; H01H 50/642; H01H 51/2272; H01H 51/2281; H01H 51/229; H01F 7/122
See application file for complete search history.

(56) References Cited

U.S. PATENT DOCUMENTS 4,286,244 A * 8/1981 Schuessler ..... H01H 51/2281 335/230
4,912,438 A 3/1990 Yokoo
(Continued)

FOREIGN PATENT DOCUMENTS

DE 2614941 A1 10/1977
DE 3802688 A1 8/1989
(Continued)

OTHER PUBLICATIONS

"Related International Application No. PCT/EP2013/056547", "International Preliminary Report on Patentability", Oct. 9, 2014, Publisher: International Bureau of WIPO, Published in: CH.
(Continued)

*Primary Examiner* — Mohamad Musleh
(74) *Attorney, Agent, or Firm* — Kaplan Breyer Schwarz & Ottesen LLP

(57) ABSTRACT

A polarized relay comprising an electromagnet, a two-pole or three-pole permanent magnet, an armature, and switches, which are mounted in and on a shelf-like support component. The support component accommodates magnetic flux pieces and the permanent magnet in an upper cavity, and the permanent magnet is magnetized while the electromagnet is still outside the support component. Subsequently, the electromagnet is inserted into lower cavity of the support component and the rest of the components of the relay are mounted.

12 Claims, 8 Drawing Sheets

(51) Int. Cl.
*H01H 49/00* (2006.01)
*H01F 7/122* (2006.01)

(56) References Cited

U.S. PATENT DOCUMENTS

| | | | |
|---|---|---|---|
| 4,975,666 | A | 12/1990 | Nobutoki |
| 5,153,543 | A | 10/1992 | Hitachi et al. |
| 6,670,871 | B1 | 12/2003 | Saso et al. |

FOREIGN PATENT DOCUMENTS

| | | | | | |
|---|---|---|---|---|---|
| DE | 19520220 | C1 | | 11/1996 | |
| DE | 19719355 | C1 | | 11/1998 | |
| DE | WO 0007199 | A2 | * | 2/2000 | ..... H01H 1/403 |
| DE | WO 0007200 | A2 | * | 2/2000 | ..... H01H 1/403 |
| EP | 0049088 | A2 | | 4/1982 | |
| EP | 0334336 | A1 | | 9/1989 | |
| GB | 838988 | A | * | 6/1960 | ..... H01H 50/16 |
| GB | 1187884 | A | * | 4/1970 | ..... H01H 51/2272 |
| JP | H06333481 | A | | 12/1994 | |
| WO | 9323866 | A1 | | 11/1996 | |

OTHER PUBLICATIONS

"Related International Patent Application No: PCT/EP2013/056547", "International Search Report and Written Opinion", Oct. 18, 2013, Publisher: PCT/ISA, Published in: EP.

"Japanese Office Action, issued in counterpart JP Application No. 2015-502328,", Sep. 17, 2015.

* cited by examiner

POLARIZED ELECTROMAGNETIC RELAY AND METHOD FOR PRODUCTION THEREOF

FIELD OF THE INVENTION

The invention relates to a method for producing a polarized electromagnetic relay comprising an electromagnet, a permanent magnet, an armature, and actuable switches, and further relates to a polarized electromagnetic relay produced by such method.

BACKGROUND OF THE INVENTION

Polarized electromagnetic relays are known in configurations with three-pole permanent magnet (WO 93/23866) and with two-pole permanent magnet (U.S. Pat. No. 4,912,438, U.S. Pat. No. 5,153,543, U.S. Pat. No. 6,670,871 B1). In any case, the electromagnet includes a coil comprising a core and pole pieces in a yoke-shaped configuration. In case of a three-pole permanent magnet, this permanent magnet is arranged between the two legs of the yoke above the coil and in parallel to the axis of the coil. This permanent magnet may be separated from a magnetized strip and inserted into the coil former between the two legs of the yoke. In case of a two-pole permanent magnet, the latter is magnetically connected transversely to the axis of the coil, with one pole approximately in the middle of the old core (U.S. Pat. No. 4,912,438, U.S. Pat. No. 5,153,543).

From U.S. Pat. No. 4,975,666 a polarized electromagnetic relay is known comprising a base housing which opens to the top, with an electromagnetic block including coil, core, and pole legs, and a permanent magnet between the pole legs, and an armature block including armature and switch elements on the pole legs mounted therein. The assembly does not permit to produce the permanent magnet located between the pole legs from an unmagnetized ferromagnetic precursor by magnetization, because this would damage the coil by excessive induced currents.

From DE 195 20 220 C1, another polarized electromagnetic relay is known, in which the coil together with two ferromagnetic yokes and a permanent magnet interposed therebetween are inserted into a base body from above and fixed with a potting compound. Magnetizing of an unmagnetized precursor in the installed state is not possible.

Also, a relay is already known (U.S. Pat. No. 6,670,871 B1) including a two-pole permanent magnet which extends in parallel to the coil axis. The plate-shaped permanent magnet having poles on the top and bottom thereof is received in an armature plate. The electromagnet is accommodated in a two-part housing which comprises a trough-shaped lower portion and a box-shaped upper portion on which the fixed contacts of the switches and the rotary supports for the armature are located. The movable contact springs are embedded in the insulating armature plate. A recess in the armature plate is adapted to accommodate the two-pole permanent magnet. The document does not disclose whether the permanent magnet is magnetized in its embedded state in the armature plate. In any case, a drawback is the large spacing between the two-pole permanent magnet and the core of the electromagnet causing a large ferromagnetic-free path in the closed magnetic flux path, which results in a large magnetic resistance in any position of the armature.

In order to be capable to implement small polarized relays, very strong permanent magnets are necessary. Such strong permanent magnets are available and include fractions of rare earths. However, because of the strong attractive forces between the magnets, their handling from a supply of individual magnets is difficult, not only in terms of the adhesion of the magnets to each other, but also in terms of keeping the pole faces free of chips and dust particles during installation. In terms of production technology it is more favorable to use a piece of material of an unmagnetized ferromagnetic alloy and to "magnetize" the "precursor" once installed in the relay. However, magnetization in place using high field strength involves the risk that other components of the magnetic system of the relay might be damaged due to strong induced voltages and currents, in particular the coil of the electromagnet.

SUMMARY OF THE INVENTION

The invention is based on the object to magnetize the permanent magnet of a polarized relay without any risk for other components of the relay.

The invention uses separate manufacturing and configuration of components of the relay in conjunction with specific manufacturing steps, so that magnetization of the permanent magnet is possible without incurring a risk of damaging the coil of the electromagnet.

Specifically, a coil assembly is provided as one component of the relay, comprising a coil, a core, and pole pieces, and further a support component is provided, in which magnetic flux pieces of the magnetic system of the relay are included, such as the pole pieces of the electromagnet and a bearing portion of the armature. These magnetic flux pieces are made of soft iron and are not damaged by high magnetic field strengths.

In a line with the magnetic flux pieces, a one-piece or two-piece permanent magnet precursor of an unmagnetized ferromagnetic alloy is installed in the support component, which will become the permanent magnet by magnetization. The support component additionally has an accommodation space into which the separately manufactured coil assembly which is the sensitive part of the electromagnet is inserted and mounted once the permanent magnet has been magnetized. Then the rest of the relay components including the switches actuated by the relay are mounted to complete the relay.

The invention also relates to a polarized electromagnetic relay comprising an electromagnet, a pole assembly including magnetic flux pieces and a permanent magnet, a support component, and an armature. The electromagnet comprises a coil assembly, which is configured as a structural unit including a coil, a core, and pole pieces. The support component preferably has a shelf-like or storey-like configuration comprising an upper cavity that defines an accommodation space for the pole assembly including the magnetic flux pieces and the magnetized permanent magnet, and an intermediate insertion cavity that defines an accommodation space for the coil assembly. The armature of the relay is pivotally mounted relative to the electromagnet on the support component, and is connected to the movable switch elements.

This configuration permits to produce even small and narrow polarized relays of high sensitivity. By modifying component parameters, various functions of polarized relays can be realized.

Further details of the invention will become apparent from the following description of two exemplary embodiments with reference to the drawings, and from the claims.

DETAILED DESCRIPTION

Figure 2:
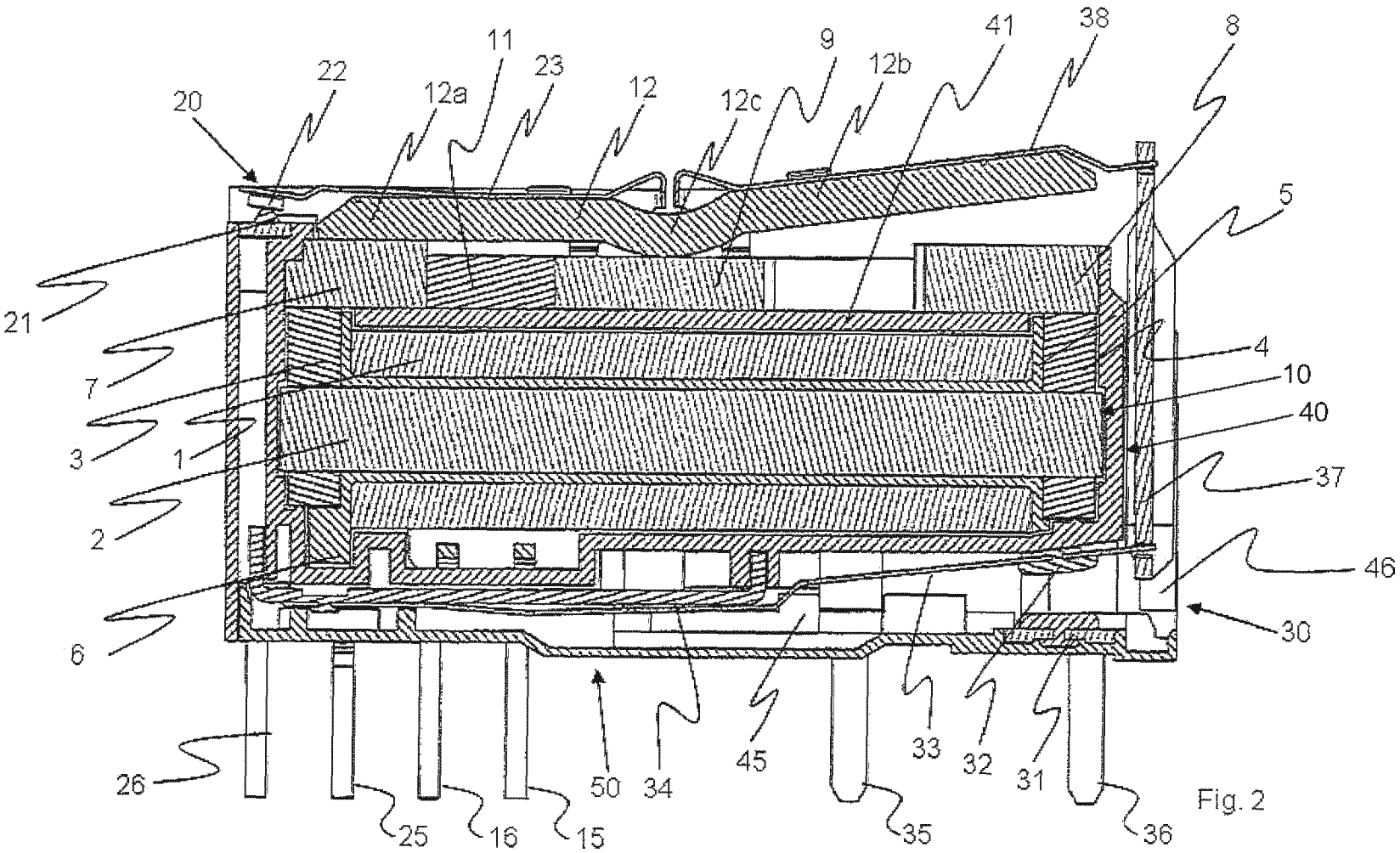
FIG. 2 is a longitudinal sectional view through the relay of the first embodiment.

The electromagnetic relay consists of a magnetic system and a switch system which are held together and protected by housing components. The magnetic system comprises an electromagnet consisting of a coil assembly 10 (FIG. 4) and pole pieces (FIG. 2). Coil assembly 10 comprises a coil 1 wound around a coil former 5, a ferromagnetic core 2, and ferromagnetic pole pieces 3 and 4, which form a structural unit. Core 2 is integrally joined to one of the two pole pieces 3, 4, or to both pole pieces. The magnetic system further comprises magnetic flux pieces 7, 8, 9, a permanent magnet 11, and an armature 12. Magnetic flux pieces 7 and 8 define the pole pieces of the electromagnet. Magnetic flux piece 9 forms a support piece for armature 12 which is in form of a rocking armature 12 in the present example. The permanent magnet 11 of the first embodiment has two poles and is arranged between pole piece 7 and magnetic flux piece 9, while between pieces 8 and 9 the magnetic flux is interrupted. It is also possible to reverse the arrangement of permanent magnet and magnetic flux gap. What is important is the orientation of the poles of the permanent magnet relative to pole piece 7 or 8, and to magnetic flux piece 9. Magnetic flux pieces 7, 8, 9 and permanent magnet 11 form a pole assembly.

In the illustrated exemplary embodiment (FIG. 4), a connection block 6 is connected to the coil assembly 10, which is not necessary for the invention. Connection block 6 comprises switch signal terminal pins 15, 16 having deflected legs 15*a*, 16*a* for direct connection to the winding ends of coil 1. A test contact terminal pin 25 is cranked and may thus be clamped between connection block 6 and pole piece 3.

Figure 3:
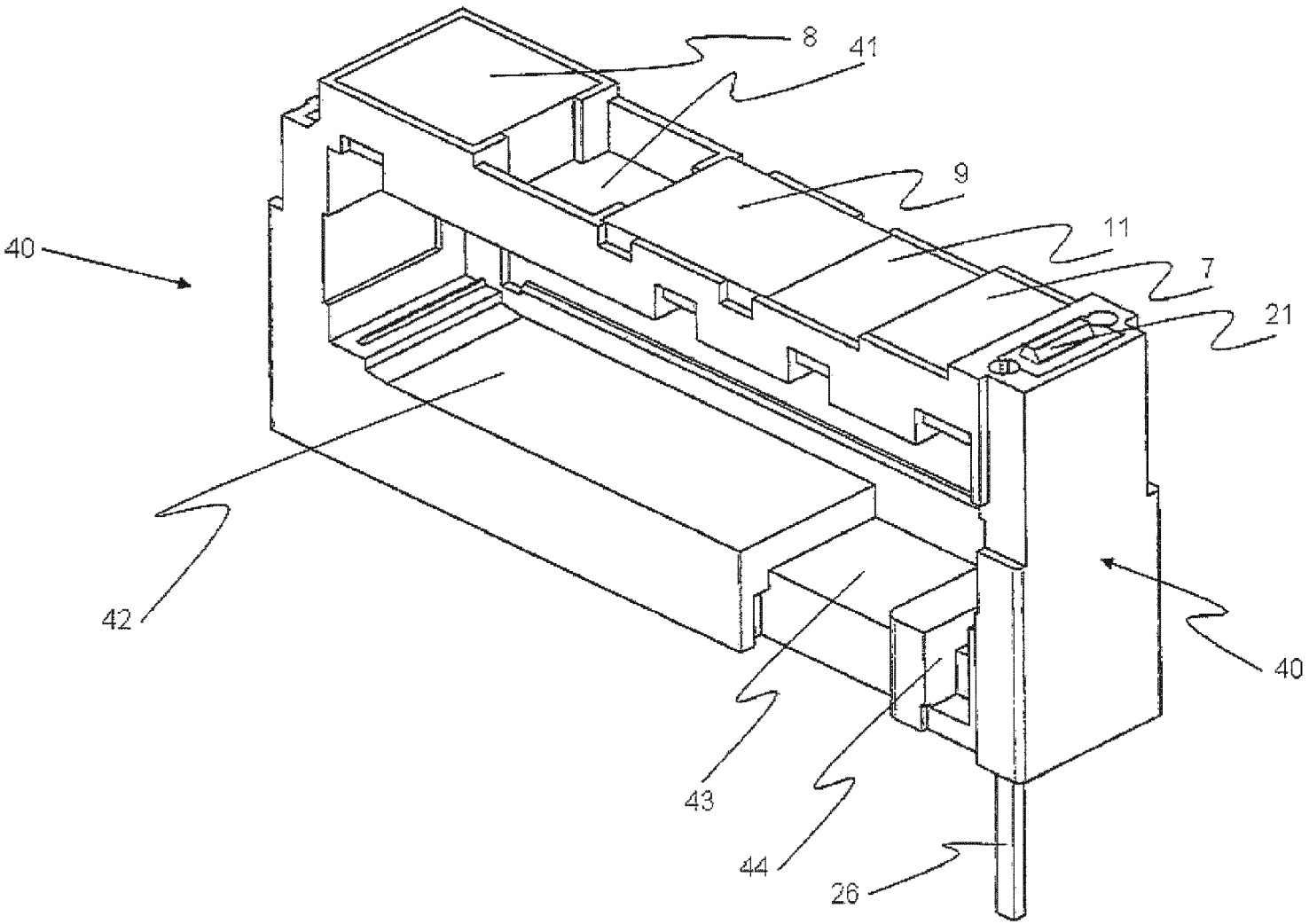
FIG. 3 is a perspective view of a support component as seen obliquely from above to a longitudinal side and a front end.
Figure 4:
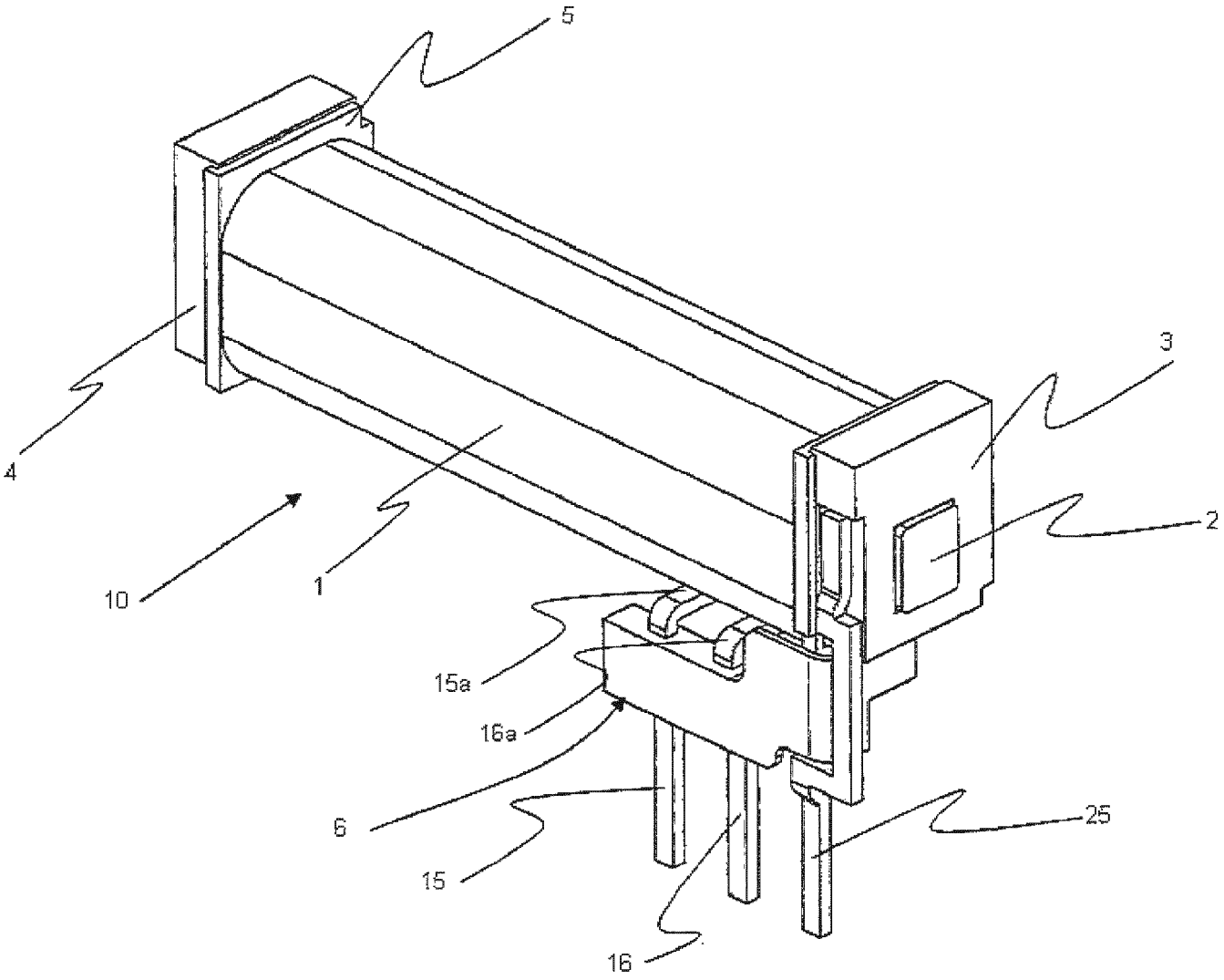
FIG. 4 is a perspective view of a coil assembly.

The component illustrated in FIG. 4 is configured for being inserted into and secured in a shelf compartment or accommodation space 42 of a shelf-like or storey-like support component 40 (FIG. 3). For this purpose, space 42 has two cavity extensions 43 and 44 for accommodating and positioning the connection block 6 in addition and adjacent to coil assembly 10.

The shelf-like or storey-like support component 40 is also adapted for accommodating the pole assembly, i.e. magnetic flux pieces 7,8, 9 and permanent magnet 11. For this purpose, an armature-side accommodation space 41 is provided and is divided into pockets. Pieces 7, 8, 9, and 11 are fixed in the support component 40 by being embedding therein. Several embedding methods are contemplated, for example, overmolding, gluing, press-fitting. Additionally, a fixed contact 21 is provided on the upper side of support component 40, which is electrically connected to a terminal pin 26 which is likewise fixed in the support component 40 by being embedding therein.

The switch system comprises a diagnostic switch 20 and at least one load switch 30. Diagnostic switch 20 comprises the fixed contact 21 and a movable contact 22 which is attached at a fork-shaped end of a contact spring 23 in form of a double contact. Contact spring 23 is secured to and actuated by the leg 12*a* of armature 12. Movable contact 22 provides the electrical connection to terminal pin 25.

In a modified embodiment of the invention, test contact terminal pin 25 is embedded in support component 40 in parallel to test contact terminal pin 26 (not shown), and two separate fixed contacts are provided on the upper side of support component 40. In this embodiment, the end of contact spring 23 is used as a bridging contact in order to close switch 20.

Load switch 30 includes a fixed contact 31 and a movable contact 32 which is seated on a contact spring 33 that is mounted to support component 40 through a power rail 34 and is moreover electrically connected to a load terminal pin 35. Fixed contact 31 is conductively connected to another load terminal pin 36. Contact spring 33 is actuated via an electrically insulating coupling member 37 whose upper end is mechanically coupled to the second leg 12*b* of armature 12. The mechanical connection may be established through an over-stroke spring 38, as illustrated, or by directly connecting the ends of rocking armature 12 and coupling member 37.

Besides the two legs 12*a* and 12*b*, armature 12 further has a curved bearing portion 12*c* by which the armature rests on magnetic flux piece 9 which is formed as a supporting piece. Depending on the operational type of the relay (monostable, bistable), the legs 12*a*, 12*b* of armature 12 have different lengths and are held by spring forces, with different pole gap widths. Such spring forces are generated by contact spring 23, over-stroke spring 38 (if provided), and contact spring 33. Contact spring 23 is riveted to the leg 12*a* of the armature and has spring projections 23*a* and 23*b* and a fastening tab 23*c* which is welded to supporting piece 9 between armature 12 and pole face 7 in a specific angular position. Over-stroke spring 38 is similarly riveted to the leg 12*b* and also has spring projections 38*a*, 38*b* and a fastening tab 38*c* which is welded to supporting piece 9. In addition to the force of contact spring 33, the torsional forces of spring legs 23*b* and 38*b* are mainly responsible for the overall spring behavior of the relay.

In addition to the spring forces, the magnetic attractive force on armature 12 makes a difference as to whether a monostable or a bistable relay is obtained. The attracting forces on the legs 12*a*, 12*b* of the armature depend on the strength of permanent magnet 11 and the size of the pole faces of pole pieces 7, 8. When in one end position of the armature the magnetic attraction force is greater than the effective spring force in the lifting direction, and in the other end position the magnetic attraction force is smaller than the lifting force of the springs, we have a monostable relay. By contrast, when in both end positions of the armature the magnetic attractive force is greater than the effective spring force in the lifting direction, we have a bistable relay.

Figure 1:
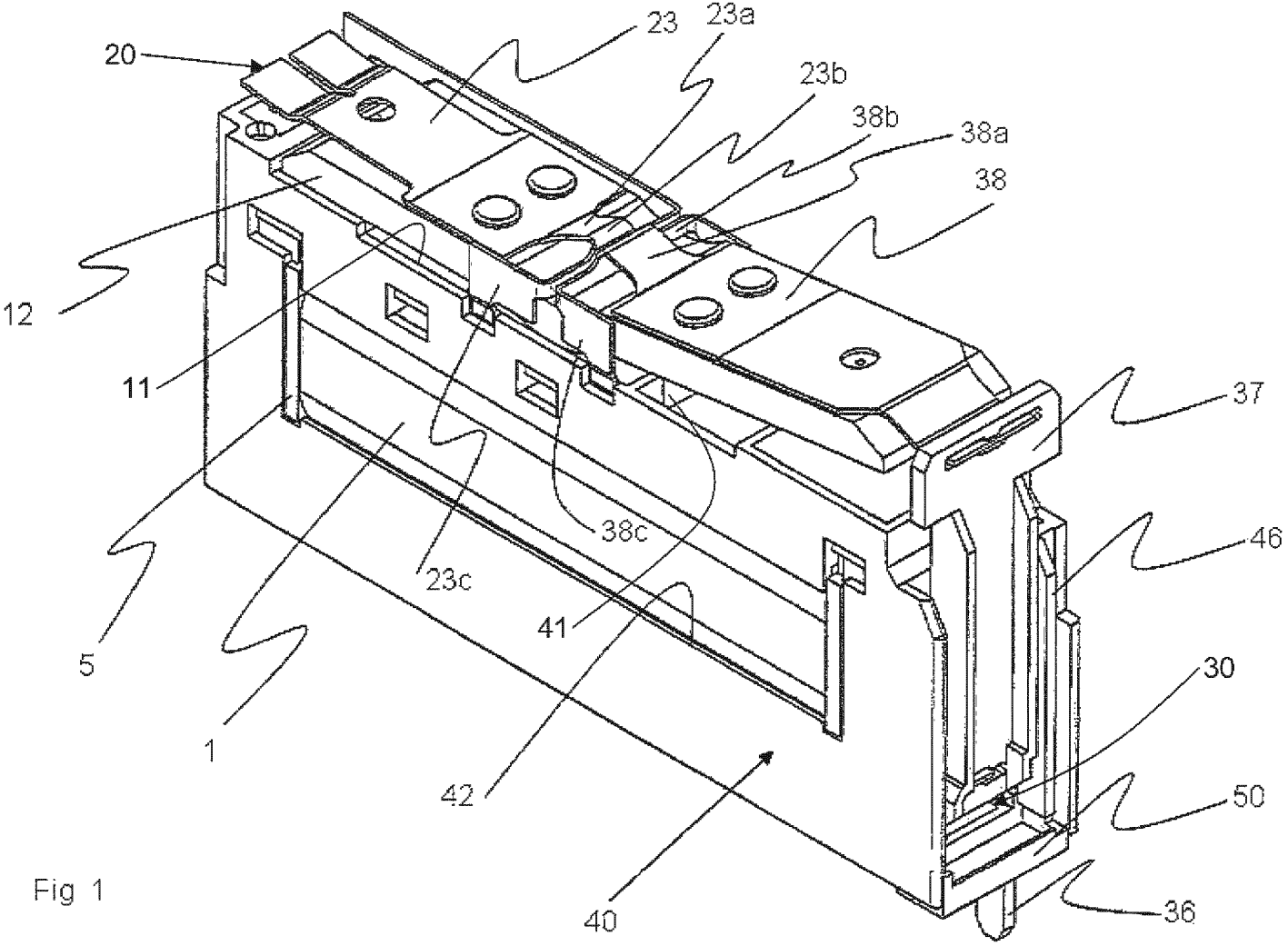
FIG. 1 is a perspective view of a first embodiment of a relay as seen obliquely from above to a longitudinal side and a short side, with the housing cap removed.

While support component 40 is the main element of the housing, a housing bottom 50 and a housing cap 60 are also provided. As illustrated in FIG. 1, support component 40 has, at its front face shown, a guideway 46 for guiding the insulating coupling member 37. This guideway and the upper side of the relay are covered by housing cap 60 of the assembled relay according to FIG. 1. A shallow cavity 45 (FIG. 2) extends along the bottom of support component 40, which cavity serves to accommodate load contact spring 33 and the movement range thereof and which is delimited at the lower side by housing bottom 50. Load contact terminal pin 36 is inserted in the bottom part 50 and riveted with the bottom part by means of fixed contact 31.

On the top of housing cap 60, a switch may be provided for manually changing the position of armature 12.

Figure 6:
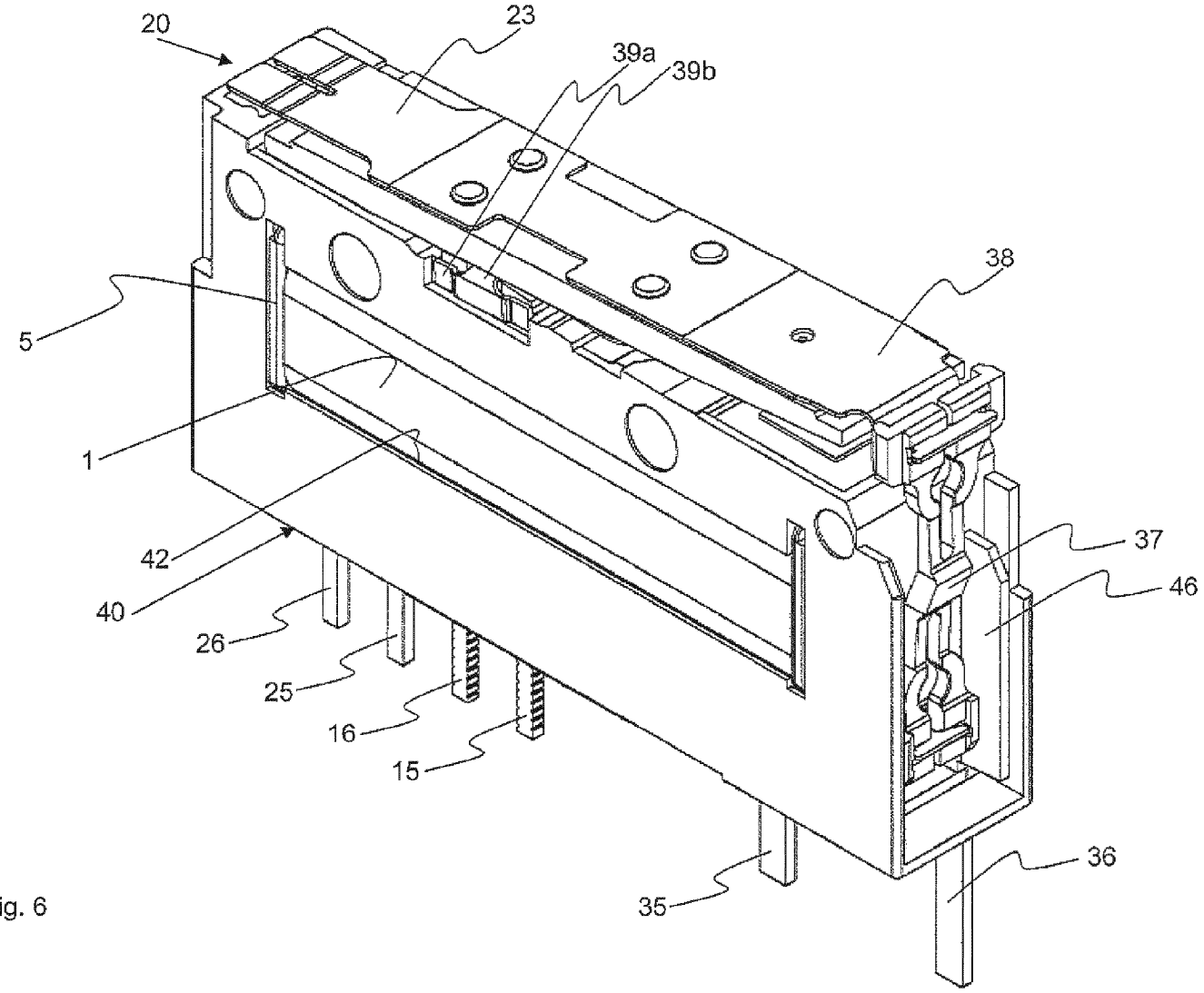
FIG. 6 is a perspective view of a second embodiment of the relay.
Figure 7:
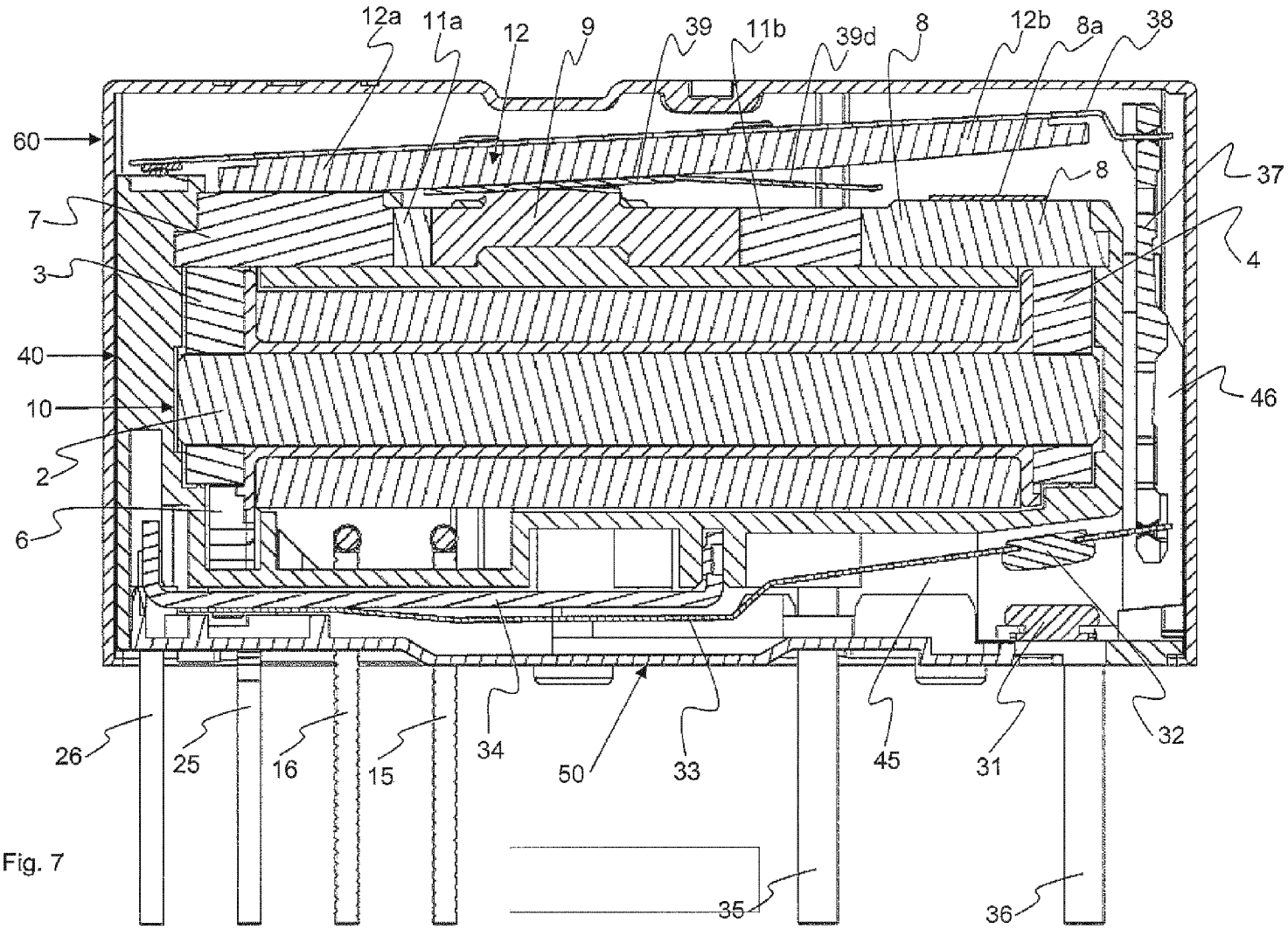
FIG. 7 is a longitudinal sectional view through the relay of FIG. 6.
Figure 8:
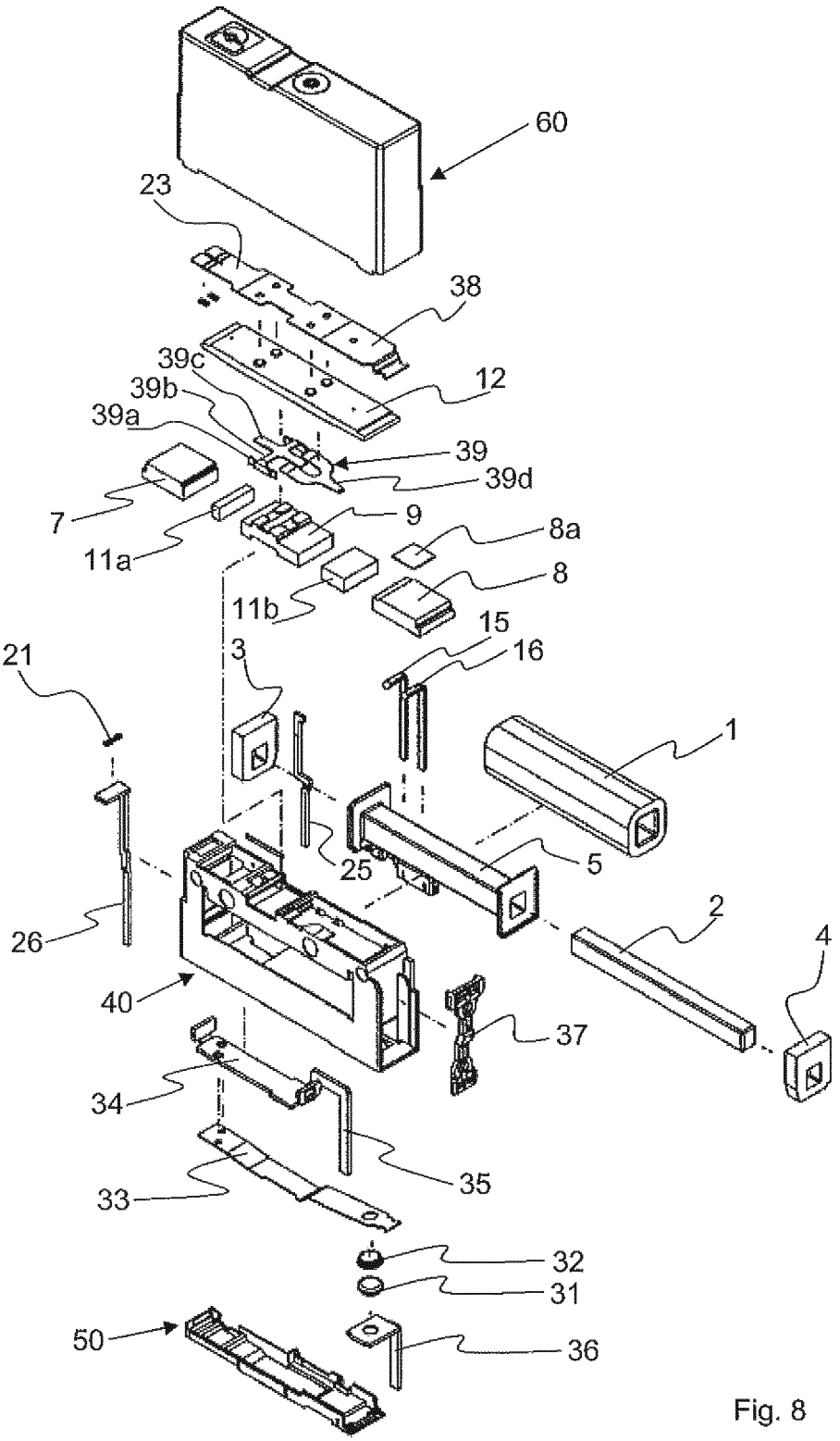
FIG. 8 is an exploded view of the individual components of the relay of FIG. 6.

FIGS. 6, 7, and 8 illustrate a second embodiment of the invention. Components similar to the first embodiment are designated with the same reference numerals. The general configuration of the relay according to the second embodiment is similar to that of the first embodiment, and therefore corresponding parts of the description will not be repeated and only the differences will be described in more detail.

In the second embodiment of the relay, permanent magnet 11 comprises two portions 11*a* and 11*b*, and interposed therebetween a magnetic flux piece 9 of soft iron so as to form a three-pole permanent magnet. Portion 11*a* has a higher coercive force when compared to portion 11*b*. The two portions 11*a* and 11*b* have the same polarity towards magnetic flux piece 9, that means either both are aligned with the south pole facing magnetic flux piece 9, or both with the north pole, while towards the outer ends of the relay, the permanent magnet 11 with a total of three poles presents only north poles, or only south poles, as the case may be. Magnetic flux piece 9 presents the adjacent polarity, i.e. south pole if the north pole of the permanent magnet faces outwards, and north pole if the south pole of the permanent magnet faces outwards.

In the second embodiment, the mounting of armature 12 is different from the first embodiment in that a cross-shaped spring 39 provides for the support of armature 12 on magnetic flux piece 9. Cross-shaped spring 39 has tabs 39*a* via which it is joined to magnetic flux piece 9 by welding, and further has a torsion web 39*b* and, transversely thereto, a support tab 39*c* for supporting armature 12.

Another tab 39*d* may extend from cross-shaped spring 39, which is adapted to dampen the impact of armature 12 on magnetic flux piece 8 and at the same time is tensioned thereby, which is useful upon a subsequent switching of the armature 12, since in this way the armature will more easily clear magnetic flux piece 8. Cross-shaped spring 39 is effective as a torsion spring, i.e. there will be no bearing friction and hysteresis loss of spring 39 is very small.

As another modification in the second embodiment, contact spring 23 and over-stroke spring 38 are formed integrally. Contact spring 23 is electrically conductive and is connected to electrically conductive armature 12 which in turn is connected, via electrically conductive cross-shaped spring 39, to electrically conductive magnetic flux piece 9 which in turn is in electrically conductive communication with test contact terminal pin 25.

For adjusting the adhesive force of leg 12*b* of armature 12 to magnetic flux piece 8, an intermediate piece 8*a* of sheet metal material or plastic is additionally provided. Namely, due to the different lengths of legs 12*a*, 12*b* of armature 12, the effective lifting forces thereon are different, which is somewhat compensated for by the interposition of piece 8*a*.

Figure 5:
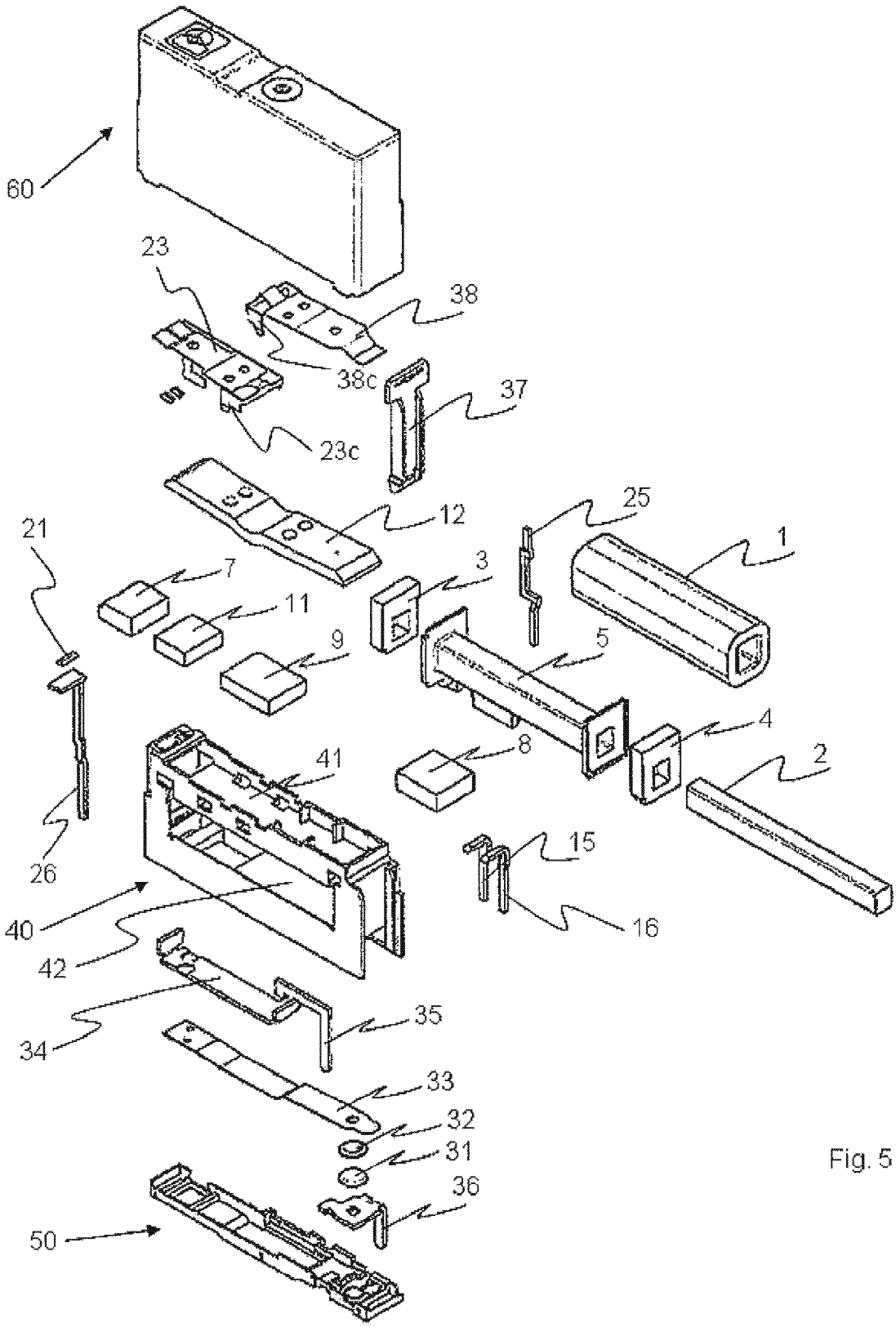
FIG. 5 is an exploded view of the individual components of the relay according to the first embodiment.

The polarized electromagnetic relay is manufactured and assembled in a novel manner. The individual components illustrated in FIG. 5 and FIG. 8 are partially assembled into units, for example the coil assembly 10 shown in FIG. 4. This coil assembly comprises at least coil 1, core 2, and pole pieces 3 and 4. In the illustrated exemplary embodiment, a coil former 5 is additionally provided to which a connection block 6 is mounted, through which the connections from the coil ends to the terminal pins 15, 16 extend.

The individual components illustrated in FIG. 5 and FIG. 8 moreover include a support component 40 which, for the purposes of the invention, is adapted to the production method of the relay. That is, support component 40 has an armature-side accommodation space 41 for magnetic flux pieces 7, 8, 9 and for permanent magnet 11, and additionally an insertion cavity-like accommodation space 42 for coil assembly 10. Magnetic flux pieces 7, 8, and 9, and permanent magnet 11 may be referred to as a pole assembly, since they present two outer poles and a center pole to armature 12. The pole assembly is inserted into accommodation space 41 of the support component 40 and is fixed therein, for example by overmolding.

A special feature of the invention is that during installation of the pole assembly, it is not a finished permanent magnet what is mounted, but a permanent magnet precursor of an unmagnetized ferromagnetic alloy that includes a fraction of rare earths. Such precursor magnets can be "magnetized" with extremely high coercive forces. To this end, a very strong magnetic field has to be applied, which magnetizes the precursor magnet in the desired direction. In practical terms, a coil has to be placed around the pole assembly to produce the required field strength. This can be accomplished in the installed state of the pole assembly within accommodation space 41 of support component 40. It will be appreciated that the accommodation space 42 for coil assembly 10 may be left empty. This prevents high voltages with a high electric current from being generated in the coil assembly, which could result in a damage thereof.

When magnetizing the pole assembly, the type of permanent magnet to be generated has to be taken into consideration. If a one-piece two-pole permanent magnet is to be produced, which corresponds to the first embodiment of the relay, the method described as above is sufficient. However, if a three-pole permanent magnet is to be produced by magnetization, the procedure is modified. Two precursor magnet portions 11*a*, 11*b* are used on either side of the central magnetic flux piece 9 and in contact with the adjacent magnetic flux pieces 7 and 8, respectively. One of these precursor magnet portions, here portion 11*a*, is made of an alloy that can be magnetized more than the other portion 11*b*. Also, the more magnetizable portion 11*a* may be made smaller than the weaker magnetizable portion 11*b*. Once the pole assembly has been mounted in the accommodation space 41 of support component 40, for example in the order of the portions of 7, 11*a*, 9, 11*b*, 8, magnetization is performed in a defined direction corresponding to the stronger permanent magnet portion 11*a*. Then, a magnetic field is applied to the pole assembly, which is weaker and opposite to the initial magnetic direction, and this weaker magnetic field is not sufficient to reverse the magnetization of permanent magnet portion 11*a*, but is sufficient to reverse the magnetization of the weaker permanent magnet portion 11*b*. A result thereof is that like poles will face each other at central magnetic flux piece 9. In this manner, a complete permanent magnet 11 is obtained with two like poles on the outer ends, i.e. towards magnetic flux pieces 7 and 8 which are effective as pole pieces, and an opposite pole on the central magnetic flux piece 9. This configuration defines a three-pole permanent magnet.

Once the permanent magnet 11 has been generated, the coil assembly 10 may be mounted in the insertion cavity-like accommodation space 42 without risk.

Then, the remaining components are mounted to complete the relay. These include the armature 12 with its springs 23, 38, and 39, the load switch 30 together with coupling member 37, and housing parts 50 and 60.

The novel relay permits to implement various functionalities of a polarized relay, by modifying the size, the arrangement, and the parameters of individual components. By creating the permanent magnet through magnetization within the support component, it is possible to use strong permanent magnets without causing complications in the assembly of the relay, since at the time of magnetization the latter does not contain any sensitive components such as the magnetic coil. The relays may be made very small, because it is possible to produce permanent magnets with high coercive force.

It will be apparent to those skilled in the art that the embodiments described above are intended as examples and that the invention is not limited thereto but may be varied in many ways without departing from the scope of the claims. Furthermore, the features also define individually significant components of the invention, irrespective of whether they are disclosed in the description, the claims, the figures, or otherwise, even if they are described together with other features.

What is claimed is:

1. A method for producing a polarized electromagnetic relay comprising an electromagnet, a permanent magnet, an armature, and an actuable switch, comprising the steps of:

a) providing a coil assembly comprising a coil with a core and pole pieces as a structural unit;

b) providing a support component that has a first accommodation space for a pole assembly extending to the side of the armature, and a second accommodation space for the coil assembly, the first and second accommodation spaces being arranged in the manner of shelf compartments;

c) mounting the pole assembly including magnetic flux pieces and an unmagnetized permanent magnet precursor in the first accommodation space;

d) magnetizing the permanent magnet precursor in the pole assembly while the second accommodation space is empty, to obtain the permanent magnet;

e) mounting the coil assembly in the second accommodation space;

f) mounting the rest of the relay components to complete the relay.

2. The method as claimed in claim 1, for providing a three-pole permanent magnet;

wherein step c) comprises mounting two precursor magnet portions which are magnetizable to a different extent, between three magnetic flux pieces of the pole assembly; and wherein step d) comprises the sub-steps of:

d1) magnetizing the two precursor magnet portions;

d2) remagnetizing the weaker precursor magnet portion in such a manner that like poles of the magnetized portions face each other at the magnetic flux piece separating them.

3. A polarized electromagnetic relay, comprising:

a support component of a shelf-like or storey-like configuration, having a first accommodation space extending to the side of an armature, a second accommodation space, and a third accommodation space, the first, second and third accommodation spaces being arranged one upon the other, the second, intermediate accommodation space being arranged in a manner of a shelf compartment;

a pole assembly comprising magnetic flux pieces defining a central magnetic flux piece and first pole pieces on either side thereof, and a magnetized permanent magnet between at least one of the first pole pieces and the central magnetic flux piece, the pole assembly being accommodated in the first accommodation space of the support component;

a coil assembly comprising a coil with a core and second pole pieces as a structural unit and forming part of an electromagnet, which is inserted in the second accommodation space;

the armature which is arranged on the pole assembly and is pivotable relative thereto, and which is connected to movable switch elements.

4. The relay as claimed in claim 3, wherein the third accommodation space of the support component accommodates a load switch and is closed by a housing bottom.

5. The relay as claimed in claim 4, wherein the housing bottom supports at least one fixed contact of the load switch, and together with the support component supports terminal pins.

6. The relay as claimed in claim 3:

wherein the electromagnet comprises a U-shaped yoke with adjacent pole pieces that define magnetic flux pieces;

wherein the armature is configured as a rocking armature having a first and a second leg, the armature being supported on the central magnetic flux piece and forming a closed low magnetic gap magnetic flux path, by a respective one of its legs together with the central magnetic flux piece and a respective one of the magnetic flux pieces operative as the first pole pieces; and wherein each of the legs actuates a movable contact of a respective switch.

7. The relay as claimed in claim 6, wherein a first switch which is usable as a diagnostic switch is formed by a fixed contact on the support component and a movable contact at a first contact spring which is fixed on the first leg of the rocking armature, and wherein a second switch which is usable as a load switch is formed by a fixed contact on the housing bottom and a movable contact at a second contact spring which is mechanically coupled to the second leg of the rocking armature through an electrically insulating coupling member.

8. The relay as claimed in claim 7, wherein the support component has a guideway for the insulating coupling member, and wherein a housing cap encloses the support component thereby partially encompassing the housing bottom.

9. The relay as claimed in claim 3, wherein the permanent magnet is a one-piece component, one pole thereof adjoining the central magnetic flux piece and the other pole thereof adjoining one of the magnetic flux pieces that are effective as magnetic poles.

10. The relay as claimed in claim 3, wherein the permanent magnet comprises two portions which are facing each other with like poles at the central magnetic flux piece so as to form a three-pole permanent magnet as a whole.

11. The relay as claimed in claim 10, wherein one of the portions has a higher coercive force than the other portion.

12. The relay as claimed in claim 11, wherein the portion with the higher coercive force occupies a smaller volume than the portion with the lower coercive force.

* * * * *